US007561494B2

(12) United States Patent
Stern

(10) Patent No.: US 7,561,494 B2
(45) Date of Patent: Jul. 14, 2009

(54) ONE OR MORE PORTABLE REMOTE DEVICES INVOLVED WITH SPORTS THAT CAN CONTROL TIME OR WHISTLE EQUIPMENT ON OR OFF THE PLAYING AREA

(75) Inventor: Max Meier Stern, Lake Forest, CA (US)

(73) Assignee: Max M. Stern, Lake Forest, CA (US)

( * ) Notice: Subject to any disclaimer, the term of this patent is extended or adjusted under 35 U.S.C. 154(b) by 142 days.

(21) Appl. No.: 11/101,432

(22) Filed: Apr. 8, 2005

(65) Prior Publication Data

US 2006/0227667 A1 Oct. 12, 2006

(51) Int. Cl.
*G04F 8/00* (2006.01)

(52) U.S. Cl. ..... 368/107; 368/12; 368/89; 340/323 R; 340/539.11

(58) Field of Classification Search ..... 368/10, 368/110, 3, 47, 113, 12, 89, 107; 340/323 R, 340/539.11, 326

See application file for complete search history.

(56) References Cited

U.S. PATENT DOCUMENTS

| | | | | |
|---|---|---|---|---|
| RE29,720 | E | 8/1978 | Fujita | 368/187 |
| 4,105,902 | A | 8/1978 | Iwai et al. | 368/155 |
| 5,847,652 | A | 12/1998 | Yamamoto | 340/574 |
| 6,067,013 | A | 5/2000 | Pejic | 340/539 |
| 6,181,236 | B1 * | 1/2001 | Schneider, Jr. | 340/326 |
| 6,369,697 | B1 | 4/2002 | Poole | 368/11 |
| 6,603,711 | B2 | 8/2003 | Calace | 368/109 |
| 2003/0210612 | A1 * | 11/2003 | Stern | 368/110 |
| 2004/0179432 | A1 * | 9/2004 | Burke | 368/46 |

* cited by examiner

*Primary Examiner*—Vit W Miska
*Assistant Examiner*—Sean Kayes
(74) *Attorney, Agent, or Firm*—Max M. Stern

(57) ABSTRACT

One or more remote control devices used at a sports event, by one or more officials, at that game, on activation can control, compatible game time pieces, without interference, that are located, on or off the playing field, with the option of initiating the sound of a whistle at activation location, or from compatible equipment, that are on or off the field, without any game time piece being altered.

5 Claims, 6 Drawing Sheets

ONE OR MORE PORTABLE REMOTE DEVICES INVOLVED WITH SPORTS THAT CAN CONTROL TIME OR WHISTLE EQUIPMENT ON OR OFF THE PLAYING AREA

CROSS-REFERENCE TO RELATED APPLICATIONS

The title of the previous application was: A single remote device from on the sports field that controls time and whistle equipment on or off the field.

Application Ser. No. 10/139,538

Filed on: May 7, 2002

The difference being in this case, is that more than one remote can be involved with a game and control whistle and time pieces on or off the field of play.

No exterior changes have been implemented on any related compatible components.

The internal electronic components in the housing of each remote has been supplemented with a receiver in the electronic circuit to receive the signal, from another remote, with the means that has already been provided, to produce a whistle sound at any location that a remote is being used.

The drawings are a repeat of the last application.

STATEMENT REGARDING FEDERALLY SPONSORED RESEARCH OR DEVELOPMENT

Not Applicable

INCORPORATED-BY REFERENCE OF MATERIAL SUBMITTED ON A DISK

Not Applicable

SEQUENCE LISTING

Not Applicable

BACKGROUND OF THE INVENTION

Sports have rules and guidelines. To see that the sport is played according to the laws, an official or officials are on the playing area or sidelines, who interpret the rules as well as dispense decisions.

Electronics have assisted in making the task of officiating sports easier and more accurate.

In many cases the whistle and game time are still performed, by using air from the mouth to produce the whistle sound, with a hand action on the game time piece. The game time piece in many sports is normally activated by an official, in conjunction with but after the whistle sound is heard. This does cause a delay in real time, in regards to the game time being as accurate as it could be, whereby if a direct relationship between the whistle and game time piece where established the accuracy factor would be more realistic, therefore having electronics incorporated, as this remote device is fitted with, has eliminated the time lost, between the whistle sound and game time being controlled, with or without a whistle sound being heard.

The device of Fujita U.S. RE 29,720 dated August 1978 is a time correction apparatus. An official at a sports event can use this, although it is not a remote control. It does not have the option of sounding a whistle, nor the ability of sending a coded transmission or to receive a coded signal to perform the function of starting or stopping a game time piece, nor to sound and control whistle related equipment.

The invention of Iwai et al U.S. Pat. No. 4,105,902 dated August 1978 is not meant to be used at a sports event. The action of this switch is a touch sensitive activation means, without the ability on activation, to sound a whistle, at activation location or transmit a signal to other equipment to sound a whistle, or start of stop a game time piece on or off the field.

The invention of Yamamoto U.S. Pat. No. 5,847,652 dated December 1998 does produce a whistle sound. The system uses two separate housings connected by a wire to complete the circuit, from activation to the mechanism that produces the sound. This device does not have any time related influence in its activation. My device fits into one housing, with the ability to control a game timepiece with or without the sound of a whistle, from on the field, by transmitting a coded signal, to other on or off the field, time or whistle compatible equipment.

The invention of Peljac U.S. Pat. No. 6,067,013 dated May 2000 is used by two sideline officials off the field of play, to obtain the attention of the main official on the field of play and to obtain the attention of other officials involved with the game. This device does not have the ability to sound a whistle, nor is it capable of controlling on or off the field game timepieces. This device when activated is normally waved in the air above the shoulders, to increase the visibility of the device, to officials, players and spectators, while my device once activated at any hand elevation, is not flashed around for visibility. More than one official, with my device, who is involved with the sport, at any time, can activate the whistle or game time piece from on the playing area or sidelines.

The invention of Poole U.S. Pat. No. 6,369,697 B1 dated April 2002 has the ability to control game related time pieces on or off the field, in a secure group. The mobile device has a single switch means to complete the circuit so that the signal to start or stop a related game time piece can be executed. This device at activation location does not have the ability to produce the sound of a whistle. The receiving equipment also does not have the means to produce a whistle sound at any location. My device at point of activation can produce a whistle sound as well as from any other remotes or compatible equipment, on or off the field of play.

The invention of Calace U.S. Pat. No. 6,603,711 B2 dated August 2003 discloses a remote that is capable of controlling time keeping devices on or of the field of play. This device on activation sends a signal that controls one or more game time pieces. This device has been configured to be worn as a glove, that requires a left or right hand, as well as sizes, which are not mentioned, as well a wrist watch or a clip on device, which are both very impractical.

The invention of Schneider U.S. Pat. No. 6,181,236 filed on Dec. 4, 1999 and issued on Jan. 30, 2001 uses air, with a conventional whistle, as well as the wireless signal is generated by the air from the whistle. My Invention does not use air.

The invention of Burke U.S. Publication 2004/0179432 filed on Feb. 18, 2004 and published on Sep. 6, 2004 is a self-regulating universal master clock that transmits the signal to other clocks to regulate the time. My Invention sends the signal to a game time piece, which has to do with a sports related event keeping track of the time still to play.

My device when activated a whistle sound can be produced at activation location electronically, this does not signify that a game time piece is being sent a coded signal to perform any function. My device does not have a time piece in or on the remote. My device has two switches that each performs two tasks. The whistle sound, with time piece activation switch is slightly raised on my device, for ease of identification. The time piece activation switch with learn mode sequence is slightly recessed on my device, so that it should not be activated inadvertently. My device can be worn from a strap or be carried in the palm of either hand, with no left or right hand, or sizes required.

None of the devices mentioned has a safety feature incorporated into any of the activation means. On pushing the whistle/time related switch, on my device, resistance as the safety phase is encountered, allowing only the whistle sound related equipment to be activated on or off the field. The game time related equipment is sent a coded signal only when the activation switch means is pushed through this safety phase in its downward movement so that no mistake should occur, to start or stop a game time piece. None of those devices mentioned, which can include one or more remote controls for use at a sport event, for whistle or watch related equipment that are on or off the field, have considered the possibility of a malfunction, a component being lost, or being taken to another location, or one field being next to each other, so that they can be set up to function once again within a group. None of these devices mentioned, elaborate on how they are going to be made compatible to work within a group, should any one or more of the above situations arise, although they might have many combinations of coded signals. All of the above mentioned devices are susceptible to water damage that can cause them to malfunction, as none are waterproof.

My remote device or devices which can be located on or off the field address's all of these issues, so that a secure, all weather, easy to carry and setup means, works within a compatible group, allowing more than one field to be next to each other.

SUMMARY OF THE INVENTION

This invention is a means with one or more hand held remote control devices, involved with that game, from on or off the playing surface, which can be carried in either palm of the users hands, or carried from a strap, whereby on being activated, a whistle sound can be heard, with the option of simultaneously transmitting a coded signal, that can control on or off the field game timepieces or whistle related sounding equipment. This device also has the means to control a game time piece with no whistle sound option, with the same activation means required, to form a secure compatible group. This feature will become more understandable when the working details are described.

The components required to complete all aspects of this sports remote device, such as the two activation switches, the speaker, the chip to produce a whistle sound, with various control boards, software, transmitters, receiver for sound activation, the power source and the strap for carrying, are all housed in or on the casing.

The device when it is going to be activated by an official involved with the game, from on the field of play or on the playing surface, he/she has various options. The reason being that to start the game a whistle is sounded and the game clock is started. This official can also activate the remote control to produce a whistle sound without transmitting a coded signal that involves the game time, as is most often the case at soccer or rugby. At basketball and American Football a whistle sound is an indication that a time piece is going to be involved. There are other sports that fall into the various categories that have time restraints, involving a whistle and time piece.

The official or officials have the right to handle a scenario that has occurred concerning the game, with their own interpretation of the law, the way they have seen fit, in certain situations. The official or officials can decide to sound the whistle at activation location, with or without sending a signal to a game timepiece to start or stop the game. The same official having stopped the flow of the game, with a whistle only sound, or if there is more than one official at the game, then the head official generally is designated to restart the game with the sound of a whistle, which this control does accommodate, not involving any game timepiece. Then an official or officials can also decide to sound a whistle and send a separate simultaneous coded signal to the components that activates the game time piece. At some sports events more than one remote device is used, therefore the required internal electronic components have been included, allowing remotes, which are within that compatible group, to receive the coded signal and then produce a whistle sound. The reason for the whistle sound option is that it could be required at some events, thereby giving more flexibility to the devices many varied sports applications.

The remote control has two switches for activation. The top switch is slightly raised for easy identification without having to look, just sense of feel. This same activation means has a safety feature incorporated, so that no signal to a game timepiece should be forwarded inadvertently.

The process of pushing this activation means causes some resistance, allowing first, only the circuit for the whistle sound, with whistle sound transmission, to become operational. The speaker will emit a whistle sound on the field of play at the remote control and a signal in code will have been forwarded to any equipment compatible to this transmission, to repeat the sound of a whistle, even in a large stadium from sound equipment, or another control or even from a clock, so all present are capable of hearing the sound.

On pushing this same top switch more firmly, it will pass through the safety phase, causing the circuit to be completed for the transmission of a coded signal to all, on or off the field related time pieces, causing the game time to start or stop, as desired by that official. The receiver in any compatible timepiece that has the correct electronics can accept this coded signal, as it has learned the code of that transmission, with the compatible mechanics imbedded in any game timepiece on or off the field.

The lower of the two activation switches is slightly recessed in the housing. The reason being that it should not be confused with the top activation switch. This switch means shares the same transmission circuit relative to the top switch, for contacting only time related compatible equipment with no whistle sound option involved.

This lower switch is integral and involved in creating compatibility between other equipment that have the capabilities to perform the functions of sounding a whistle or of changing the game time, on or off the field.

When an official or officials normally arrive at the field of play before the game starts, certain particular relevant things pertinent to the game have be to be checked out, be it at a swimming event or hockey game, such as the condition of the playing area, the lights, the nets, the corner flags, are all the lines or perimeters correctly marked, are the goals or posts in order, are the game time related watches on or off the field set correctly as well as making sure that his/her whistle works, be it air or electronic. This being the case, the equipment in this group has to be checked out to establish that all, on or off the field whistles or game timepieces are compatible and working in unison, as well as should there be more than one remote device involved with that event, it has also to be set up.

This is achieved by with one remote control, that the one or main official is going to use, who subsequently pushes down on the lower of the two activation switches through the safety phase, to close the circuit of the learn mode sequence, for at least 3 seconds, as well as the learn mode switch has to be pushed in simultaneously on any other remote device, timepiece or whistle equipment, on or off that field, with that technology and held down for at least 3 seconds to allow for compatibility, so they can work within a secure group. This will allow any watches, small or large visible time pieces to be brought in line, including any whistle sound apparatus on or off the field to be configured, to accept this signal in code. This can be done one at a time or collectively, as this causes the software to recognize the coded signal that is going to be transmitted and received, from one or more involved field remote controls.

The reason for this feature being very important is that, should any compatible component malfunction, a new replacement can be configured to work within that group, also allowing more that one field to be alongside another, as it gives each group it's own coded compatible signal. Another very important facture for this feature is that this remote, or a complete other remote or remotes, can be taken to another location, or a different part of, off the field component of this equipment, can be moved and then be configured to work within another secure group to sound a whistle or control a game time piece.

These details with the features of this invention will become more apparent upon review of the description of the various adaptations and associated drawings that are appended hereto, It is from these materials as a whole that the scope of protection sought by the invention may be gleamed.

BRIEF DESCRIPTION OF THE DRAWINGS

Drawing

Drawing

Drawing

Drawing

Drawing

Drawing

Drawing

NUMERALS OF THE EMBODIMENT

Figure 1:
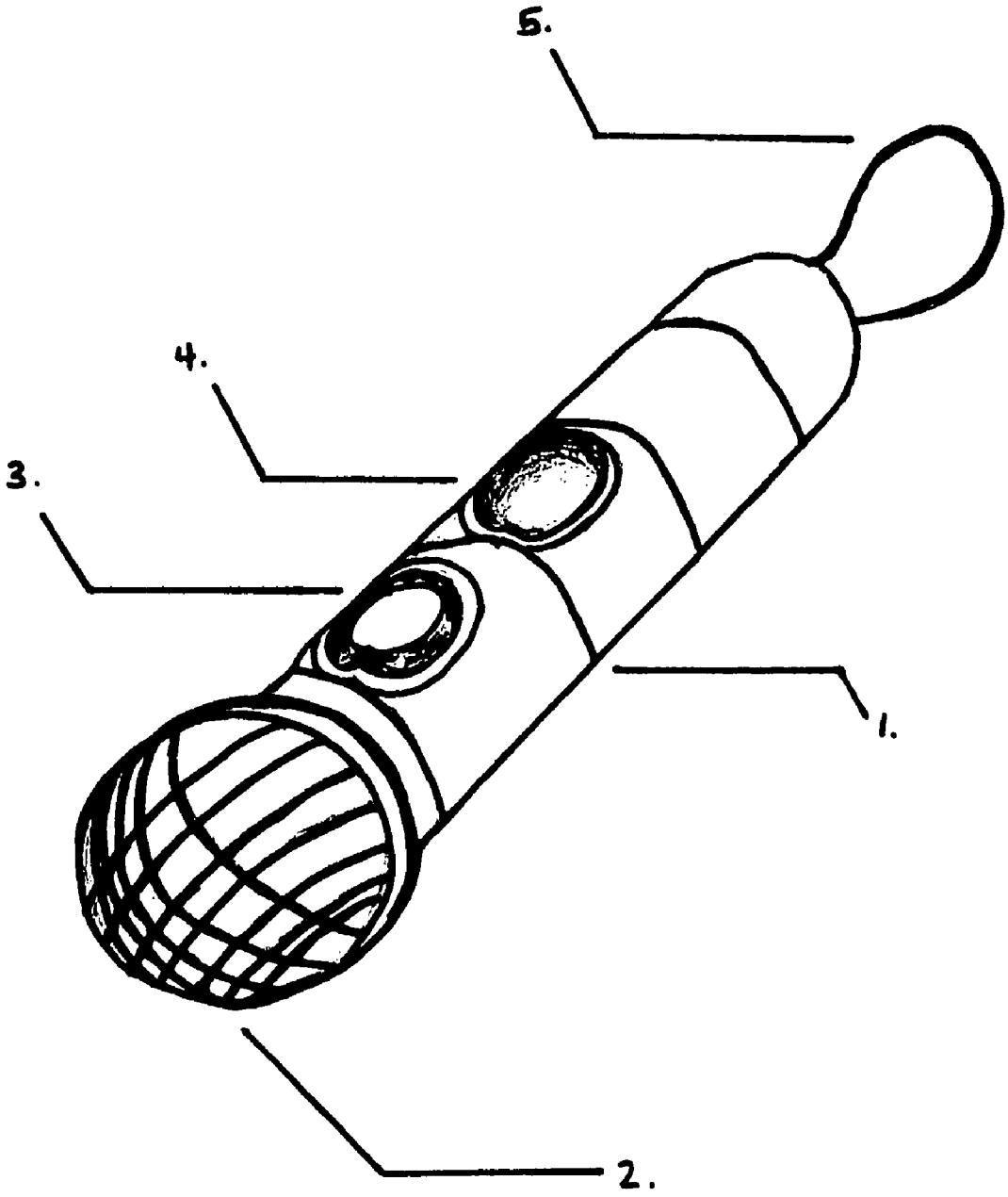
FIG. 1 is an outside side view of the remote housing control showing the placing of the external components.

1) housing
2) speaker
3) raised activation switch
4) recessed activation switch
5) strap
6)
7) electric watch
8) compatible receiver
9) power source
10) whistle sound chip
11) transmitter control board
12) connections
13) learn switch on receiver
14) sound control board
15A) cylinder sleeve for the top switch
15B) cylinder sleeve for bottom switch
15C) bottom of cylinder for top switch
15D) bottom of cylinder for bottom switch
16) antenna on time transmitter
17) sound contact points
18) learn mode software
19) sound transmitter antenna
20) whistle circuit connection
21) contact points connecting the raised switch
22) contact points connecting the recessed switch
23) resistance spring below raised switch
24) spring on recessed switch

DETAILED DESCRIPTION OF THE DRAWINGS

This invention concerns one or more portable remote devices used at a sports event by one of more officials who are involved with the game, who control and interpret the rules. The actual remote control device is carried in the hand or worn from a strap, with the ability on activation to sound a whistle, at that activation location, or just transmit in code to other compatible related equipment, to either emit the sound of a whistle, with or without controlling on or off the field compatible time pieces, or the option to start or stop game related time pieces, that are on or off the field, with no whistle sound being heard.

Referring to FIG. 1. clearly shows all of the components that are incorporated on the outside of the cylindrical housing (1) such as the two activation switches (3) and (4) that are required to activate the integral mechanism, which fits into the palm of either hand or can be carried from a strap (5) or worn around the neck, while at the other end of the housing (1) is the speaker (2) to emit the whistle sound.

Figure 2:
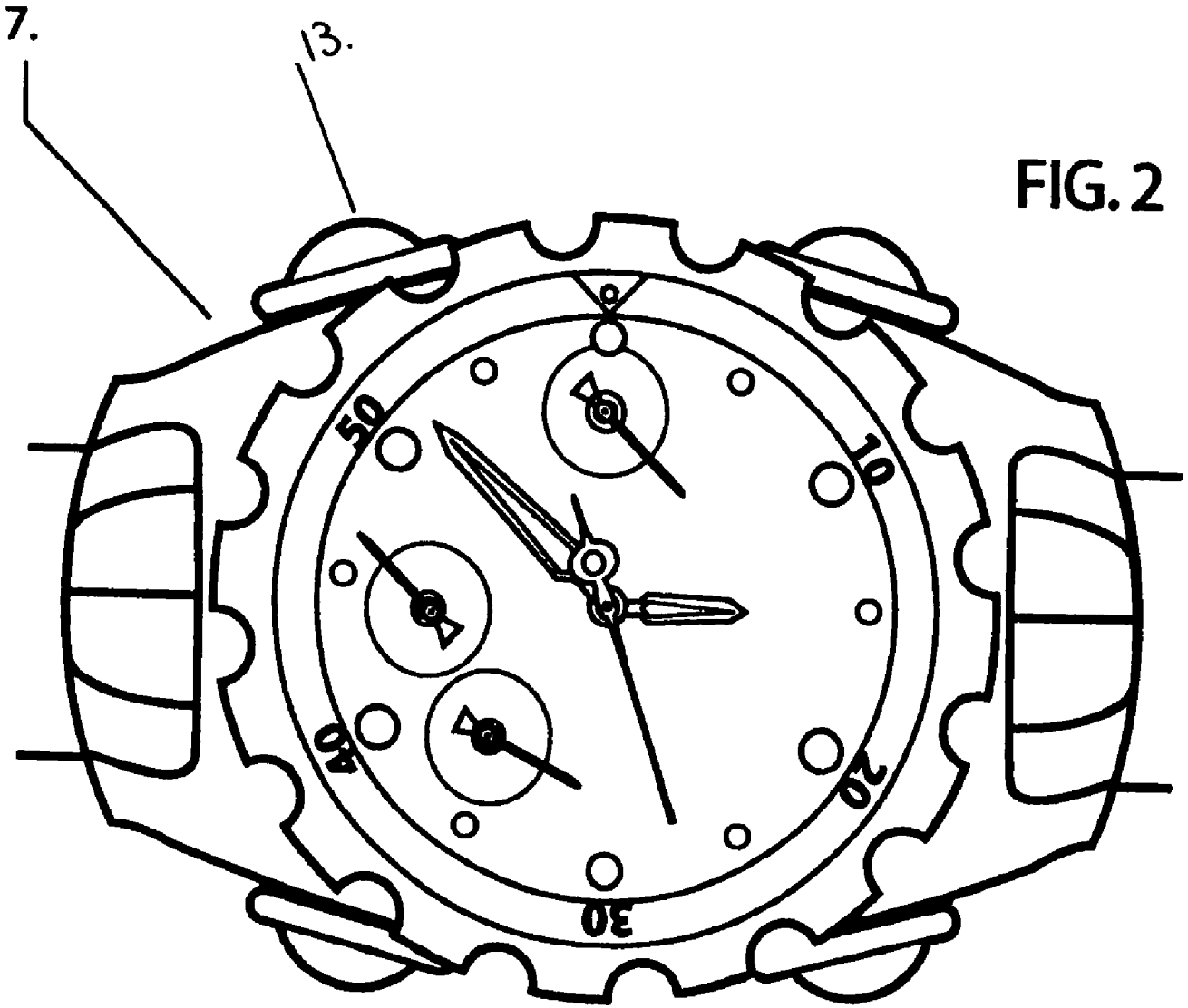
FIG. 2 is an outside top view of a game wrist watch.

Referring to FIG. 2. a wrist stop watch (7) is used for the purpose of illustrating a crucial component allowing this and other time pieces or whistle sound related equipment to become compatible and work within a group. The learn switch (13) is shown on the game stop watch time piece, that is worn by one or more officials involved with that game.

In the case a large off field game clock is used, as long as it has been fitted with the same components it can be controlled to start or stop, when the signal is received, with whistle features if required.

Figure 3:
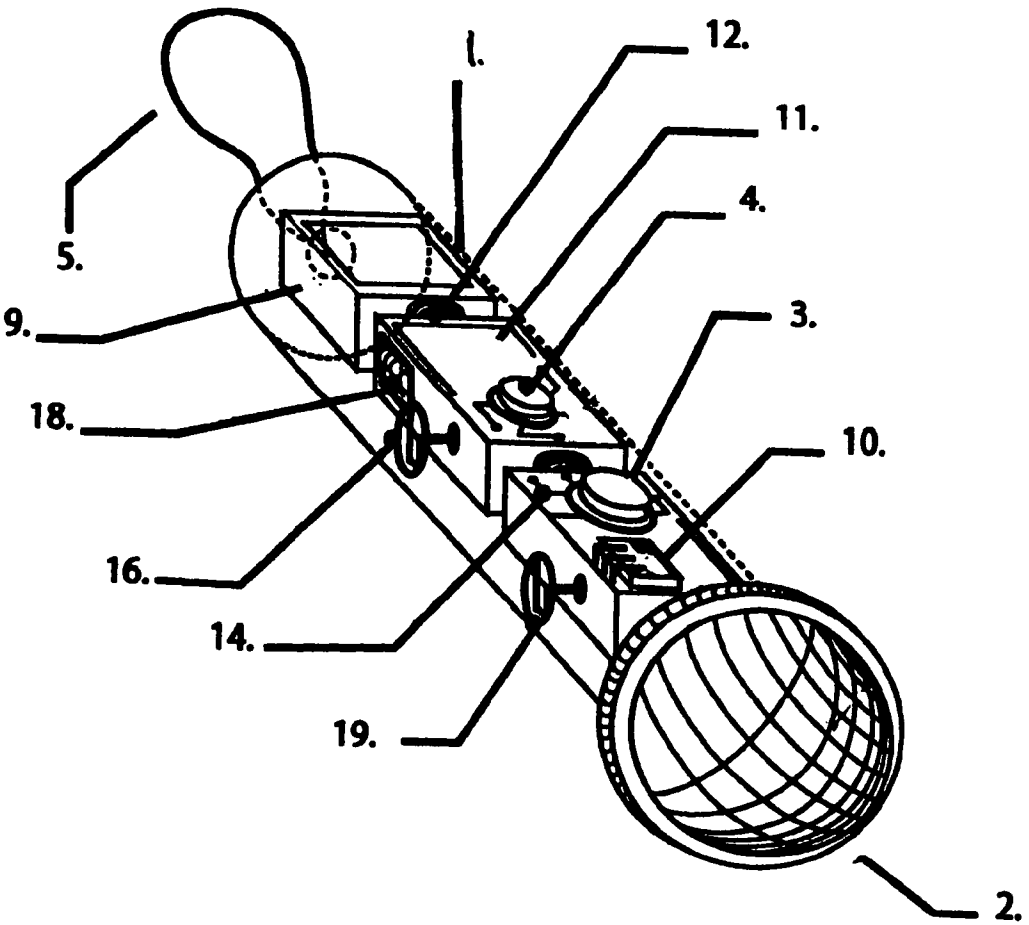
FIG. 3 is a cut away view of the inside of the housing of one remote device showing the placement of all the relevant internal and external components.

Referring to FIG. 3. clearly shows the working components of this remote device, with the speaker (2) at one end, with the carrying strap (5) at the other end. The power source (9) is connected (12) to all aspects of the internal electronic components. The sound control board (14) that assists the whistle sound to be emitted at activation from the speaker (2) carries the whistle chip (10) with the antenna (19) to transmit the coded signal to other compatible whistle related equipment on or off the field. This is activated when the top switch (3) which is slightly raised, for ease of identification, on the housing (1) is pressed downward and encounters resistance, allowing the safety phase feature to come into effect, so that only the connection for the whistle with sound and transmission, is heard and transmitted, from the sound control board (14) so that no inadvertent coded signal should be forwarded to any on or off the field game timepieces, by completing the circuit to transmit a coded signal to related timepieces. In the case that some sports have more than one official this has been taken into consideration, as other remotes have electronics (12) included so that a whistle sound is emitted from all of the remotes involved with that game.

This same top switch (3) when pushed beyond this safety phase, allows the circuit from the sound control board (14) to the transmitter control board (11) to be completed, then via the antenna, on the time transmitter (16) the transmission of a coded signal, to compatible receivers to start or stop a game time piece on or off the field is sent.

The slightly recessed lower switch (4) is located just below the housing (1) surface so that it should not be mistaken for the top switch (3). When this lower switch (4) is activated, resistance is encountered, allowing initially only the circuit to transmit a coded signal to on or off the field related game time pieces, with no whistle sound option, to be send the coded signal. The same transmitter control board (11) that the top switch (3) utilizes is brought into the loop, to perform the function of alerting all related time equipment to stop or start.

This recessed activation switch (4) performs another very important function in this whole setup.

This activation switch (4) to perform the other task has to pushed through the safety phase so that the learn mode sequence can be engaged. This learn mode software (18) on the transmitter control board (11) is the means of forming a secure group. This is achieved by the switch (4) closing the circuit for at least 3 seconds or more, while the learn mode software switch in those other components also has to be held down for at least 3 seconds, whereby whistle and time piece related equipment can be engaged to perform there task from on or off the field of play, to become a secure group. The components do not, all have to be matched up at the same time, as they can be set up individually.

Figure 4:
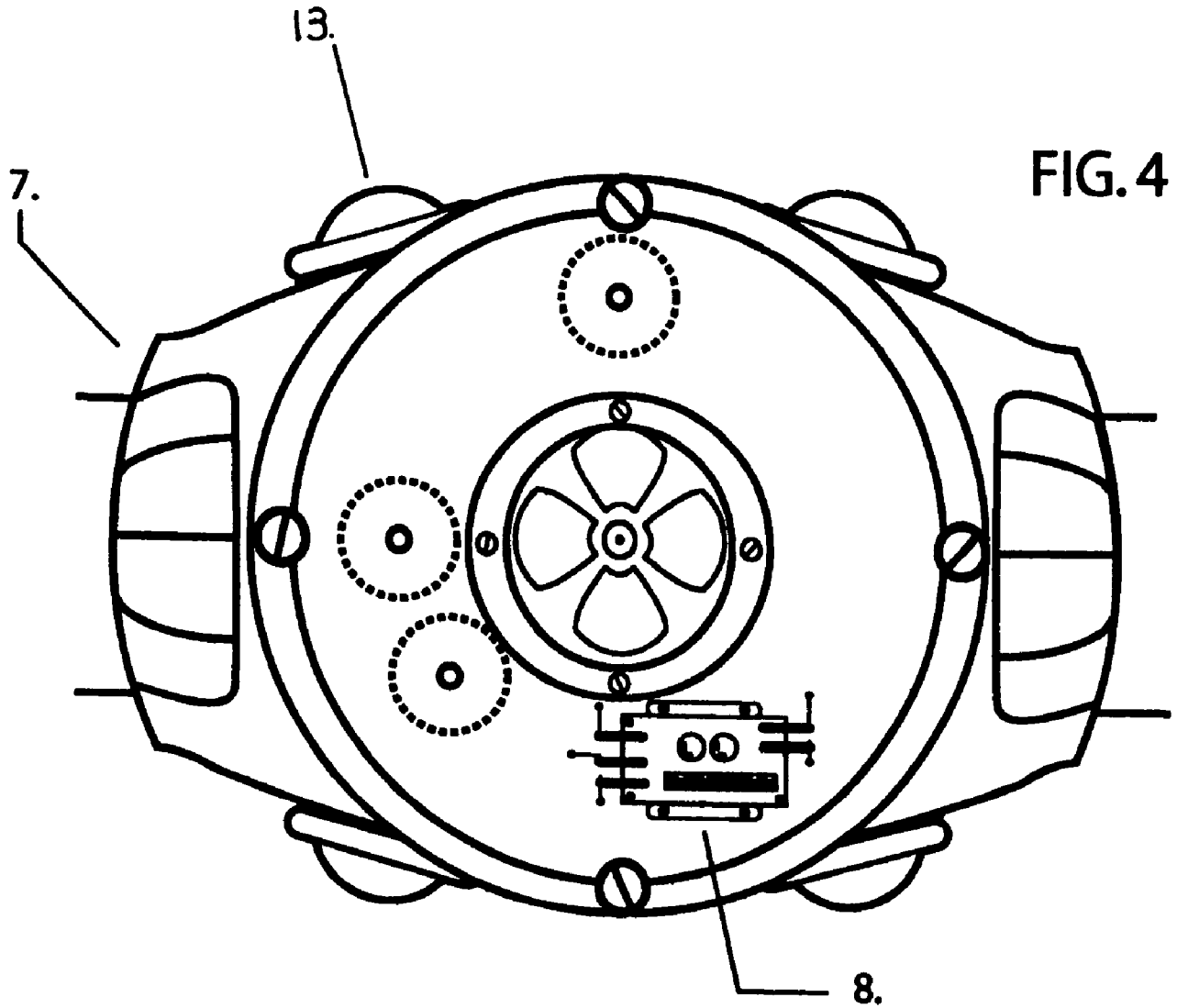
FIG. 4 is a front view of the watch or clock without the face showing the learn switch and internal components.

Referring to FIG. 4. the face of the stop watch (7) on the field of play has been removed so that the internal related components are visible. The same internal electronics can be found, in on the field small or large off the field watch related equipment, that can accept the coded signal to perform the task of starting or stopping, for others to see the game time. These game related time pieces might also be equipped with the components that allows them to sound a whistle at their location or locations.

The main official, before the start of the game, as a matter of routine has all of the watches or clocks, that are on or off the field set to the same allowed playing time, for that game. To achieve this and to make all of the equipment that is going to be used compatible, this lower activation switch (4) is pushed downwards through the safety phase and held down for at least 3 seconds on the remote device housing (1) causing activating of the learn mode software (18), in the housing (1), while that person or others at the same time are pushing the learn mode button (13) on any other remote, time piece or whistle related equipment for at least 3 seconds to allow the receiver (8) in that piece of equipment, with that software to accept the coded signal, that establishes compatibility, thereby being able to work within that secure group to accept the coded signal. This method is applied, should another piece of equipment be required to be made compatible at that or any other location.

Figure 5:
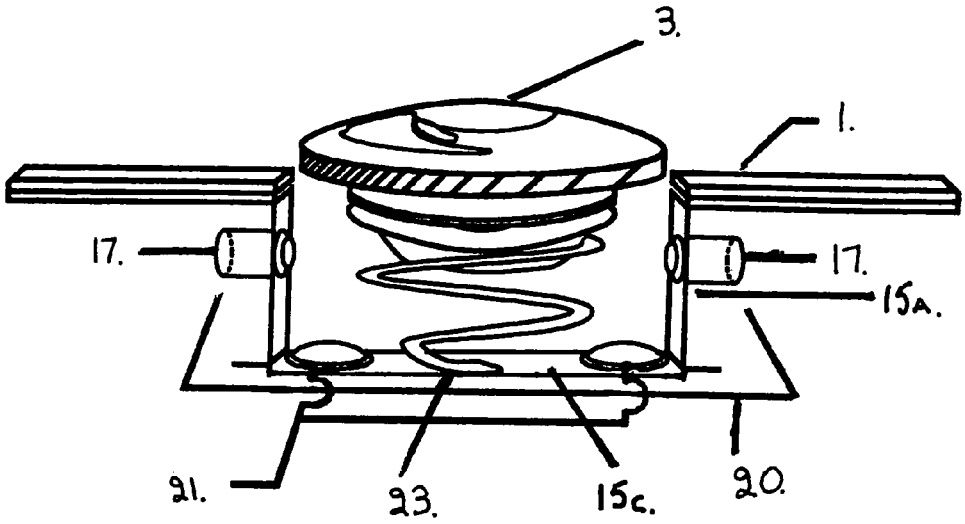
FIG. 5 is a side cut away view of the top switch, showing it slightly elevated above the housing, with the wire connections below the waterproof cylinder sleeve.

Referring to FIG. 5. shows the activation switch (3) slightly raised on the housing (1) for ease of identification, with the spring (23) attached underneath. When this activation switch (3) is pushed downward, the resistance feature is encountered that has been incorporated by a spring (23), causing the sound contact points (17) to be engaged first, inside the cylindrical sleeve (15A), thereby allowing the whistle sound circuit connection (20) to be completed to the sound control board (14) thereby allowing the whistle sound to be heard at activation location, while sending a coded signal to whistle related equipment on or off the field, whereby a whistle sound is emitted from the various compatible whistle sound equipment.

When the resistance phase of the spring (23) is overcome by pushing the activation switch (3) more firmly downward in the cylindrical sleeve (15A), thereby closing the contact points (21) connecting the raised switch (3) to the transmitter control board (11) the circuit has now been completed and a coded signal is transmitted to watch compatible related equipment, which is on or off the field, to start or stop a time piece, whereby the whistle sound has been emitted fractionally earlier, yet having nothing what so ever, to do with the actual mechanism for controlling any game time piece.

The cylindrical sleeve (15A) is open at the top to accommodate the top activation switch (3) allowing it to move inside the sleeve, with the bottom seal (15C) which protrudes into the housing (1) making it waterproof.

Figure 6:
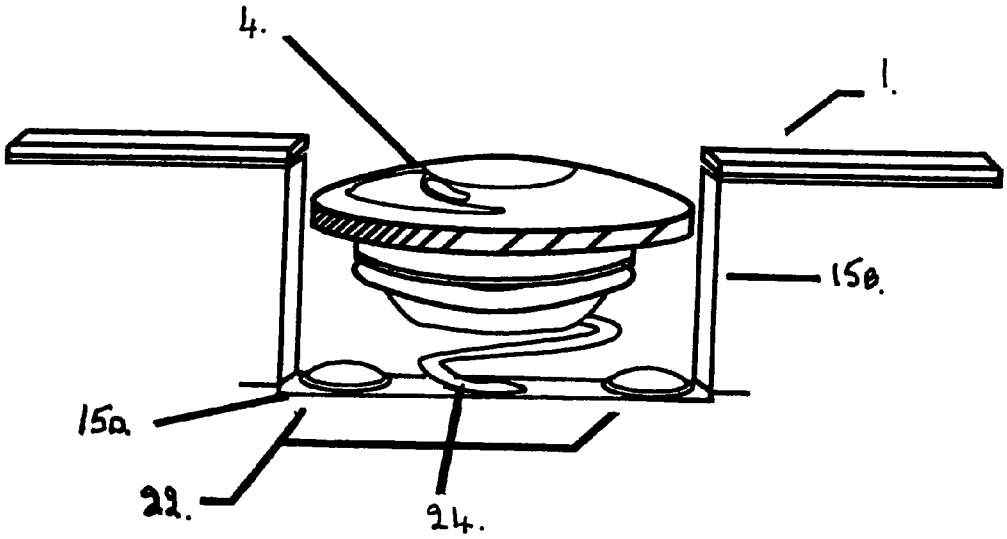
FIG. 6 is a side cut away view of the lower switch, showing it slightly recessed on the housing, with the wire connections below the waterproof cylinder sleeve.

Referring to FIG. 6. shows the bottom activation switch (4) slightly recessed in the cylindrical sleeve (15B), so that it should not be confused with the whistle/time activation switch (3) on the housing (1). The top of the cylindrical sleeve (15B) is open, to allow the bottom activation switch (4) to move freely downward until resistance is encountered in this sleeve (15B) that is sealed at the bottom of the cylinder (15D), which protrudes into the housing (1), making the sleeve (15B) waterproof. The spring (24) causes resistance, allowing initially only the connection (22) to be completed, so that a coded signal can be transmitted, to compatible time equipment, with no sound equipment being involved. When the resistance of the safety phase is overcome, by pushing this switch (4) more firmly downwards and then being held down in that position for at least 3 seconds, the means, to synchronize with other related equipment in this group to be become compatible, is achieved.

Figure 7:
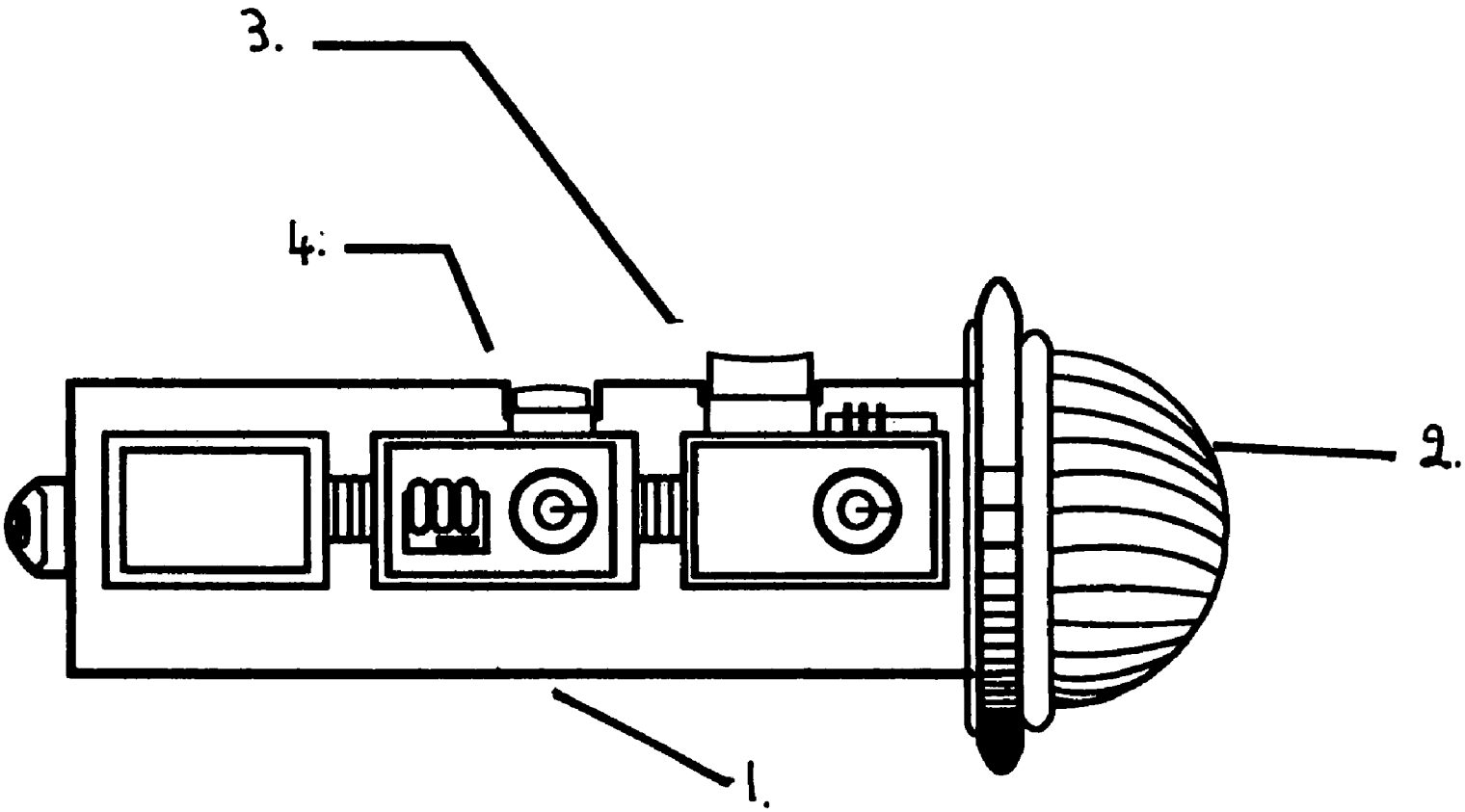
FIG. 7 is a side cut away view of the two activation switch means.

Referring to FIG. 7. this view shows the location of the activation switches (3) and (4) more clearly on the housing (1) just below the speaker (2) with each having a very different profile on the housing (1).

Accordingly, the main objective of this invention is a simple means to instantly transmit a coded signal from one or more remote devices, involved with that sport or game, to compatible receivers on or off the field, to initiate a whistle sound at activation location on or off the field, with the option to either start or stop a clock or watch, virtually simultaneously, with or without a whistle sound being heard. This will increase the accuracy of time keeping at sports events, also simplify the officials task of keeping the game time, with the option of having a whistle sound or other time keeping equipment, on or off the field, for players, other officials, participants and spectators, to hear the whistle or see the game time.

The remote device is waterproof. This one or other remote devices or related compatible equipment that are fitted with the electronic means, can be moved to other locations, should even a battery fail, or a component malfunction, a new group can then very simply be configured to work once again as a secure unit, that can even be passed from one official to another very easily, while also allowing fields to be next to each other with no interference. These and other features of the invention will become more apparent upon review of the various adaptations and associated drawings that are appended hereto. It is from these materials as a whole that the scope of protection sought by the inventor may be gleamed.

What is claimed is:

1. One or more Remote Control Devices that are used at a sports event by one of more officials to control whistle or game time pieces, on or off the playing area for that game comprising:

A) a portable cylindrical housing;

B) the housing capable of being carried from a strap at the lower end;

C) activation switches for the internal components being located on the outside of the housing;

D) a transmitter for whistle related wireless transmissions located inside the housing;

E) a transmitter for time keeping related wireless transmissions located inside the housing;

F) a whistle sound electronic reproduction component inside the housing;

G) a whistle speaker situated on the outside of the housing at the top; and

H) a receiver inside each remote so that it can accept an incoming coded signal to activate the whistle related components from another compatible remote device.

2. The remote device of claim 1 further comprising:

a first button raised relative to the cylindrical housing, and a second button recessed relative to the cylindrical housing.

3. The remote device of claim 2, wherein both the first and second button comprise two switches each; each button is biased by a spring such that partial application of force activates only a first switch and application of additional force activates the second switch.

4. The remote device of claim 3, wherein upon partial application of a force to the first button a first switch is operated and a whistle operation to be performed; the whistle operation comprises outputting of a whistle sound and transmission of a whistle signal; the whistle signal causes compatible equipment to output whistle sounds; upon application of additional force to the first button, a second switch of the first button is operated and a timing signal is transmitted, the timing signal causes compatible equipment to perform a start or stop timing operation of the official game time.

5. The remote device of claim 3, wherein upon partial application of a force to the second button a third switch is operated, an internal timing operation is performed, and a timing signal is transmitted, the timing signal causes compatible equipment to start or stop a timing operation; upon application of additional force to the second button, a fourth switch is operated, a learn function is initiated to allow synchronization of multiple devices.

* * * * *